US009368862B2

(12) United States Patent
Oh et al.

(10) Patent No.: US 9,368,862 B2
(45) Date of Patent: Jun. 14, 2016

(54) WIDEBAND ANTENNA AND AN ELECTRONIC DEVICE INCLUDING THE SAME

(71) Applicant: Nvidia Corporation, Santa Clara, CA (US)

(72) Inventors: Sung Hoon Oh, Santa Clara, CA (US); Joselito Gavilan, Santa Clara, CA (US); Warren Lee, Santa Clara, CA (US)

(73) Assignee: NVIDIA CORPORATION, Santa Clara, CA (US)

( * ) Notice: Subject to any disclaimer, the term of this patent is extended or adjusted under 35 U.S.C. 154(b) by 160 days.

(21) Appl. No.: 14/159,880

(22) Filed: Jan. 21, 2014

(65) Prior Publication Data

US 2015/0207219 A1 Jul. 23, 2015

(51) Int. Cl.

| | |
|---|---|
| ***H01Q 1/24*** | (2006.01) |
| ***H01Q 1/48*** | (2006.01) |
| ***H01Q 1/50*** | (2006.01) |
| ***H01Q 13/10*** | (2006.01) |

(52) U.S. Cl.

CPC ..... *H01Q 1/48* (2013.01); *H01Q 1/243* (2013.01); *H01Q 1/50* (2013.01); *H01Q 13/106* (2013.01)

(58) Field of Classification Search

CPC ..... H01Q 1/24; H01Q 13/10
USPC ..... 343/702, 722, 700 MS
See application file for complete search history.

(56) References Cited

U.S. PATENT DOCUMENTS

| | | | |
|---|---|---|---|
| 4,125,810 | A | 11/1978 | Pavio |
| 5,861,854 | A | 1/1999 | Kawahata et al. |
| 6,229,487 | B1 | 5/2001 | Sadler et al. |
| 6,476,769 | B1 | 11/2002 | Lehtola |
| 6,911,940 | B2 | 6/2005 | Poilasne et al. |
| 7,091,908 | B2 | 8/2006 | Fabrega-Sanchez |
| 7,362,286 | B2 | 4/2008 | Fang |
| 7,551,142 | B1 | 6/2009 | Zhang et al. |
| 7,696,928 | B2 | 4/2010 | Rowell |
| 8,421,682 | B2 | 4/2013 | Nielsen et al. |
| 8,648,752 | B2 | 2/2014 | Ramachandran et al. |

(Continued)

FOREIGN PATENT DOCUMENTS

| | | | |
|---|---|---|---|
| CN | 101106211 | A | 1/2008 |
| CN | 101442151 | A | 5/2009 |

(Continued)

OTHER PUBLICATIONS

Oh, Sung Hoon, et al., U.S. Appl. No. 14/159,880, filed Jan. 21, 2014, entitled "Wideband Antenna and an Electronic Device Including the Same".

(Continued)

*Primary Examiner* — Huedung Mancuso

(57) ABSTRACT

Provided is an antenna. The antenna, in one embodiment, includes a feed element having a first feed element end and a second feed element end, the first feed element end configured to electrically connect to a positive terminal of a transmission line. The antenna, in this embodiment, further includes a ground element having a first ground element end and a second ground element end, the first ground element end configured to electrically connect to a negative terminal of the transmission line. In this particular embodiment, the first ground element end is located proximate and inside the first feed element end, and the second ground element end is located proximate and outside the second feed element end.

20 Claims, 2 Drawing Sheets

(56) References Cited

U.S. PATENT DOCUMENTS

| | | | | |
|---|---|---|---|---|
| 8,665,162 | B2 | 3/2014 | Koga | |
| 8,698,673 | B2 | 4/2014 | Wong et al. | |
| 8,766,859 | B2 * | 7/2014 | Merz | H01Q 1/243 343/702 |
| 8,779,999 | B2 | 7/2014 | Gummalla | |
| 8,836,587 | B2 * | 9/2014 | Darnell | H01Q 1/243 343/700 MS |
| 8,957,827 | B1 | 2/2015 | Lee et al. | |
| 2002/0146909 | A1 | 10/2002 | Yang et al. | |
| 2004/0252061 | A1 | 12/2004 | Vance | |
| 2006/0082506 | A1 | 4/2006 | Fang | |
| 2006/0139211 | A1 | 6/2006 | Vance et al. | |
| 2006/0208950 | A1 * | 9/2006 | Tago | H01Q 1/243 343/702 |
| 2007/0182658 | A1 * | 8/2007 | Ozden | H01Q 1/243 343/866 |
| 2008/0106478 | A1 | 5/2008 | Hill | |
| 2008/0231521 | A1 * | 9/2008 | Anguera Pros | H01Q 1/243 343/702 |
| 2010/0033380 | A1 * | 2/2010 | Pascolini | H01Q 1/243 343/700 MS |
| 2010/0271264 | A1 | 10/2010 | Li et al. | |
| 2010/0321255 | A1 | 12/2010 | Kough et al. | |
| 2011/0001675 | A1 | 1/2011 | Lee | |
| 2011/0260938 | A1 * | 10/2011 | Xie | H01Q 9/0421 343/722 |
| 2012/0046002 | A1 | 2/2012 | Hill et al. | |
| 2012/0154223 | A1 | 6/2012 | Oh et al. | |
| 2012/0173754 | A1 | 7/2012 | Dalrymple et al. | |
| 2012/0214412 | A1 | 8/2012 | Schlub et al. | |
| 2012/0249393 | A1 | 10/2012 | Hotta et al. | |
| 2012/0299785 | A1 | 11/2012 | Bevelacqua | |
| 2013/0050057 | A1 | 2/2013 | Hayashi et al. | |
| 2013/0135156 | A1 | 5/2013 | Tsai et al. | |
| 2014/0118194 | A1 | 5/2014 | Gavilan et al. | |
| 2014/0118204 | A1 | 5/2014 | Gavilan et al. | |
| 2014/0141731 | A1 | 5/2014 | Abudul-Gaffoor et al. | |
| 2014/0159989 | A1 | 6/2014 | Malek et al. | |
| 2014/0232612 | A1 | 8/2014 | Jenwatanavet | |
| 2014/0266938 | A1 | 9/2014 | Ouyang et al. | |
| 2015/0015445 | A1 | 1/2015 | Sanchez | |
| 2015/0022401 | A1 | 1/2015 | Gavilan et al. | |
| 2015/0022402 | A1 | 1/2015 | Gavilan et al. | |
| 2015/0207228 | A1 | 7/2015 | Oh et al. | |
| 2015/0207230 | A1 | 7/2015 | Oh et al. | |
| 2015/0207231 | A1 | 7/2015 | Oh et al. | |

FOREIGN PATENT DOCUMENTS

| | | | |
|---|---|---|---|
| CN | 201927704 | A | 8/2011 |
| DE | 69723366 | T2 | 4/2004 |
| DE | 102013017512 | A1 | 5/2014 |
| EP | 2405533 | A1 | 1/2012 |
| TW | 201101591 | A | 1/2011 |

OTHER PUBLICATIONS

Oh, Sung Hoon, et al., U.S. Appl. No. 14/160,036, filed Jan. 21, 2014, entitled "Wideband Loop Antenna and an Electronic Device Including the Same".

Oh, Sung Hoon, et al., U.S. Appl. No. 14/160,231, filed Jan. 21, 2014, entitled "Co-Located Antennas and an Electronic Device Including the Same".

Oh, Sung Hoon, et al., U.S. Appl. No. 14/160,277, filed Jan. 21, 2014, entitled "Single Element Dual-Feed Antennas and an Electronic Device Including the Same".

* cited by examiner

WIDEBAND ANTENNA AND AN ELECTRONIC DEVICE INCLUDING THE SAME

TECHNICAL FIELD

This application is directed, in general, to antennas and, more specifically, to wideband antennas for handheld electronic devices.

BACKGROUND

Handheld electronic devices are becoming increasingly popular. Examples of handheld devices include handheld computers, cellular telephones, media players, and hybrid devices that include the functionality of multiple devices of this type, among others.

Due in part to their mobile nature, handheld electronic devices are often provided with wireless communications capabilities. Handheld electronic devices may use long-range wireless communications to communicate with wireless base stations. For example, cellular telephones may communicate using 2G Global System for Mobile Communication (commonly referred to as GSM) frequency bands at about 850 MHz, 900 MHz, 1800 MHz, and 1900 MHz, among possible others. Communication is also possible in the 3G Universal Mobile Telecommunication System (commonly referred to as UMTS, and more recently HSPA+) and 4G Long Term Evolution (commonly referred to as LTE) frequency bands which range from 700 MHz to 3800 MHz. Furthermore, communications can operate on channels with variable bandwidths of 1.4 MHz to 20 MHz for LTE, as opposed to the fixed bandwidths of GSM (0.2 MHz) and UMTS (5 MHz). Handheld electronic devices may also use short-range wireless communications links. For example, handheld electronic devices may communicate using the Wi-Fi® (IEEE 802.11) bands at about 2.4 GHz and 5 GHz, and the Bluetooth® band at about 2.4 GHz. Handheld devices with Global Positioning System (GPS) capabilities receive GPS signals at about 1575 MHz.

To satisfy consumer demand for small form factor wireless devices, manufacturers are continually striving to reduce the size of components that are used in these handheld electronic devices. For example, manufacturers have made attempts to miniaturize the antennas used in handheld electronic devices. Unfortunately, doing so within the confines of the wireless device package is challenging.

Accordingly, what is needed in the art is an antenna, and associated wireless handheld electronic device, that navigate the desires and problems associated with the foregoing.

SUMMARY

One aspect provides an antenna. The antenna, in this aspect, includes a feed element having a first feed element end and a second feed element end, the first feed element end configured to electrically connect to a positive terminal of a transmission line. The antenna, in this embodiment, further includes a ground element having a first ground element end and a second ground element end, the first ground element end configured to electrically connect to a negative terminal of the transmission line. In this particular embodiment, the first ground element end is located proximate and inside the first feed element end, and the second ground element end is located proximate and outside the second feed element end.

Another aspect provides an electronic device. The electronic device, in this aspect, includes storage and processing circuitry, input-output devices associated with the storage and processing circuitry, and wireless communications circuitry including an antenna. The antenna, in this aspect, includes: 1) a feed element having a first feed element end and a second feed element end, the first feed element end configured to electrically connect to a positive terminal of a transmission line, and 2) a ground element having a first ground element end and a second ground element end, the first ground element end configured to electrically connect to a negative terminal of the transmission line, wherein the first ground element end is located proximate and inside the first feed element end, and the second ground element end is located proximate and outside the second feed element end.

BRIEF DESCRIPTION

Reference is now made to the following descriptions taken in conjunction with the accompanying drawings, in which.

DETAILED DESCRIPTION

The present disclosure is based, at least in part, on the recognition that wireless networks are constantly evolving to increase speed and improve data communication, and that the latest cellular network, called Long Term Evolution (LTE) or 4G, not only operates in different frequency bands amongst carriers, but also between different regions. As a result, mobile electronic devices, such as smart phones, tablets and laptops, will need to support multiple LTE bands in addition to the legacy 3G (UMTS) and 2G (GSM) bands.

Table 1, set forth below, lists the 2G, 3G and 4G frequency bands for AT&T and Verizon, as well as the commonly deployed frequency bands in EMEA and APAC.

TABLE 1

| Frequency Bands | | | | |
|---|---|---|---|---|
| Band | Frequency | AT&T | Verizon | EMEA/APAC |
| 17 | 704-746 | 4G | | |
| 13 | 746-787 | | 4G | |
| 5 | 824-894 | 2G/3G | 2G/3G | |
| 8 | 880-960 | | | 2G/3G |
| 4 | 1710-1755, 2110-2155 | 4G | | 4G |
| 3 | 1710-1880 | | | 2G/4G |
| 2 | 1850-1990 | 2G/3G | 2G/3G | |
| 1 | 1920-1980, 2110-2170 | | | 3G/4G |
| 7 | 2500-2690 | | | 4G |

The addition of these frequency bands creates a significant challenge for antenna designers, since the antennas will now need to cover additional bands in the same allocated volume.

With this recognition in mind, the present disclosure acknowledged, for the first time, that a wideband antenna capable of accommodating the aforementioned frequencies is achievable by having an internally coupled ground element at least partially surrounding the feed element from the inside of the feed element. For example, if the ground element is parallel and closely located along a perimeter of the feed element, a magnetically coupled slot antenna may be formed, which in one embodiment may accommodate the aforementioned frequencies. Moreover, by adding a parasitic element, wherein the feed element is at least partially positioned between the ground element and the parasitic element, further improvements may be obtained.

Figure 1:
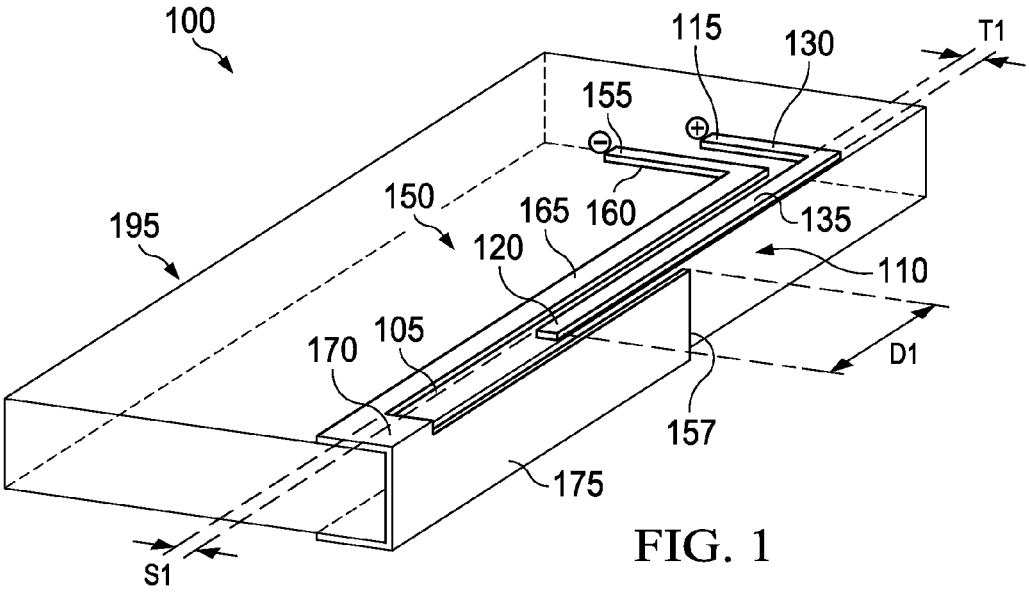
FIG. 1 illustrates an antenna manufactured and designed according to one embodiment of the disclosure.

Turning to FIG. 1, illustrated is an antenna 100 manufactured and designed according to one embodiment of the disclosure. The antenna 100, in the embodiment of FIG. 1, includes a feed element 110 and a ground element 150. The feed element 110, in one embodiment, might directly connect to a positive terminal of a transmission line (not shown), such as a coaxial cable, microstrip, etc., to receive radio frequency signals from associated transceivers. The feed element 110 may additionally receive radio frequency signals from other antennas, and thus provide them to the associated transceivers. In contrast, the ground element 150 might directly connect to a negative terminal of the transmission line (not shown). The ground element 150, in accordance with one embodiment of the disclosure, may connect to or form a portion of the conductive chassis 195.

The feed element 110 illustrated in the embodiment of FIG. 1 includes a first feed element end 115 and a second feed element end 120. In the embodiment of FIG. 1, the first feed element end 115 is the end that might directly couple to the positive terminal of the transmission line. Conversely, the second feed element end 120, in the embodiment shown, is not directly coupled to anything. Further to the embodiment of FIG. 1, the feed element 110 includes a first feed element section 130 and a second feed element section 135. The first feed element section 130 has a length ($L_{F1}$) and the second feed element section 135 has a length ($L_{F2}$). In one embodiment, the length ($L_{F1}$) is less than ½ the length ($L_{F2}$). In the illustrated embodiment, the length ($L_{F1}$) is less than ⅓ the length ($L_{F2}$). In the illustrated embodiment, the first and second feed element sections 130, 135 are substantially perpendicular to one another.

The ground element 150 illustrated in the embodiment of FIG. 1 includes a first ground element end 155 and a second ground element end 157. In the embodiment of FIG. 1, the first ground element end 155 is the end that might directly couple to the negative terminal of the transmission line. Conversely, the second ground element end 157, in the embodiment shown, is not directly coupled to anything.

Further to the embodiment of FIG. 1, the ground element 150 includes a first ground element section 160, a second ground element section 165, a third ground element section 170, and a fourth ground element section 175. The first ground element section 160 has a length ($L_{G1}$), the second ground element section 165 has a length ($L_{G2}$), the third ground element section 170 has a length ($L_{G3}$), and the fourth ground element section 175 has a length ($L_{G4}$). In one embodiment, the length ($L_{G1}$) and length ($L_{G3}$) are less than the length ($L_{G1}$) and the length ($L_{G4}$). Additionally, the length ($L_{G3}$) is often the longest of the lengths.

In the illustrated embodiment, the first and second ground element sections 160, 165 are substantially perpendicular to one another, the second and third ground element sections 165, 170 are substantially perpendicular to one another, and the third and fourth ground element sections 170, 175 are substantially perpendicular to one another. Further to this embodiment, the first and third ground element sections 160, 170 are substantially parallel to one another, and the second ground element section 165 is substantially perpendicular to at least a portion of the fourth ground element section 175. In the illustrated embodiment, the second ground element section 165 is substantially parallel to at least another portion of the fourth ground element section 175.

In accordance with the disclosure, the illustrated embodiment has the first ground element end 155 being located proximate and inside the first feed element end 115. The term "inside", as used in this context, requires that an element be closer (e.g., relatively speaking) to a center point of the device. Accordingly, in this embodiment, the first ground element end 155 is located closer to a center point of the device than the first feed element end 115. Further in accordance with the disclosure, the illustrated embodiment has the second ground element end 157 being located proximate and outside of the second feed element end 120. The term "outside", as used in this context, requires that an element be further (e.g., relatively speaking) from a center point of the device. Accordingly, in this embodiment, the second ground element end 157 is located further from the center point of the device than the second feed element end 120.

To accommodate the aforementioned layout (e.g., with regard to inside and outside), in one embodiment the fourth ground element section 175 at least partially surrounds the second feed element section 135. For example, the fourth ground element section 175 might surround the second feed element section 135 by a distance ($D_1$). In accordance with one embodiment of the disclosure, the distance ($D_1$) is at least about ⅙ the length ($L_{G4}$). In accordance with another embodiment of the disclosure, the distance ($D_1$) is at least about ¼ the length ($L_{G4}$), and in yet another embodiment, the distance ($D_1$) is at least about ½ the length ($L_{G4}$). Accordingly, in the embodiment shown, the second feed element end 120 is fully surrounded by the ground element 150.

The feed element 110 and ground element 150, in certain embodiments, are substantially parallel to one another. For example, in certain embodiments, the perimeters of the feed element 110 and ground element 150 are substantially parallel to one another. In the illustrated embodiment of FIG. 1, the first ground element section 160 is positioned inside and parallel to an inner perimeter of the first feed element section 130, the second ground element section 165 is positioned inside and parallel to an inner perimeter of the second feed element section 135, and the fourth ground element section 175 is positioned outside and parallel to an outer perimeter of the second feed element section 135.

In accordance with one embodiment of the disclosure, the feed element 110 and ground element 150 are proximate one another. In one embodiment, the feed element 110 and ground element 150 are separated by a maximum spacing ($S_1$). In accordance with one embodiment, the maximum spacing ($S_1$) is less than about three times a minimum thickness ($T_1$) of the feed element 110. In accordance with another embodiment, the maximum spacing ($S_1$) is less than about 3 mm, and in yet another embodiment less than about 2 mm (e.g., between about 1 mm and 2 mm). The aforementioned maximum spacing ($S_1$) is important to help the feed element 110 tightly couple to the ground element 150.

In accordance with one embodiment of the disclosure, the feed element 110 and ground element 150 magnetically couple to one another (e.g., in one embodiment as a result of the specific layout) to form a wideband coupled slot 105 antenna. The antenna 100 achieves this, in one embodiment, by orienting the ground element 150 such that it at least partially surrounds the feed element 110, beginning from the inside of the feed element 110. By orienting the ground element 150 and feed element 110 in this fashion, an extremely low quality factor (low-Q) multi-band antenna resonating structure, having wide bandwidths for both the low and high bands, is achievable. For example, such an antenna is capable of a lower band bandwidth ranging from about 704-960 MHz and a higher band bandwidth ranging from about 1500-2200 MHz. Interestingly, the higher band bandwidth may encompass the GPS and Glonass frequencies. Additionally, such an antenna 100 has an extremely low profile capable of meeting the volume constraints in some of today's smaller devices.

Figure 2:
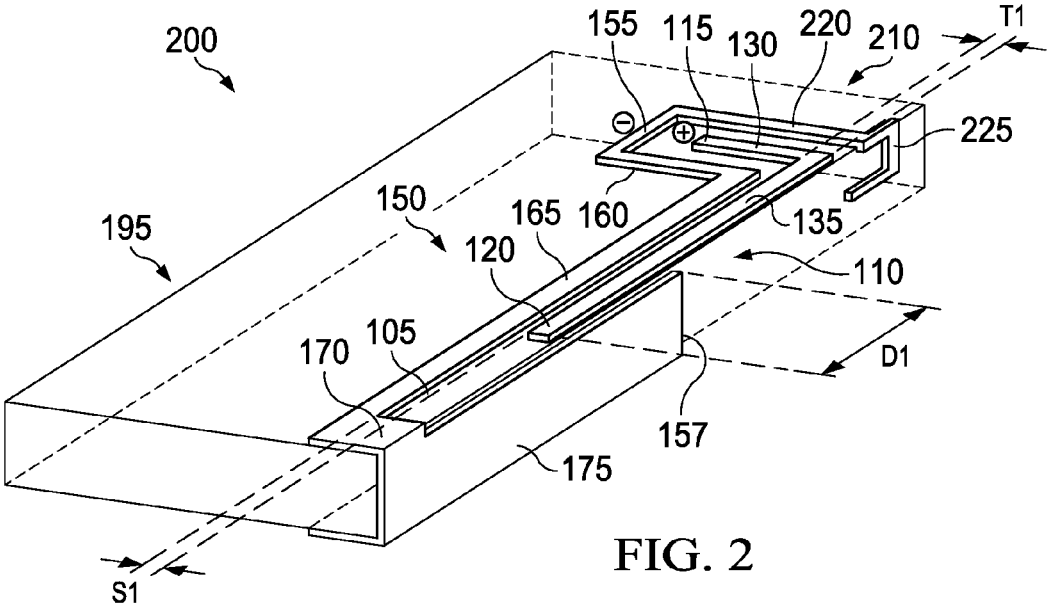
FIG. 2 illustrates an antenna manufactured and designed according to another embodiment of the disclosure.

FIG. 2 illustrates alternative aspects of a representative embodiment of an antenna 200 in accordance with embodiments of the disclosure. Where used, like reference numerals indicate similar features to the antenna 100 of FIG. 1. In addition to many of the features of FIG. 1, the antenna 200 includes a parasitic element 210. The parasitic element 210, in one embodiment, might directly connect to a negative terminal of the transmission line (not shown). In fact, in the embodiment shown, the parasitic element 210 directly couples to the first ground element end 155. The parasitic element 210, in one embodiment, is configured to improve the bandwidth of the high band resonance.

In the illustrated embodiment, the parasitic element 210 includes a first parasitic element section 220 and a second parasitic element section 225. The first parasitic element section 220, in this embodiment, is substantially perpendicular to the second parasitic element section 225. Moreover, the first parasitic element section 220 is located proximate and parallel to the first feed element section 130.

A length ($L_3$) of the parasitic element 210 may be modified to help tune the resonant frequency of the antenna 200, particularly the higher band resonant frequency. For example, by increasing the length ($L_3$), the lower band resonant frequency and lower band impedance loop would likely remain about the same, but the higher band resonant frequency would slightly decrease. Those skilled in the art, given the present disclosure, would understand the steps required to employ a parasitic element, such as the parasitic element 210.

Figure 3:
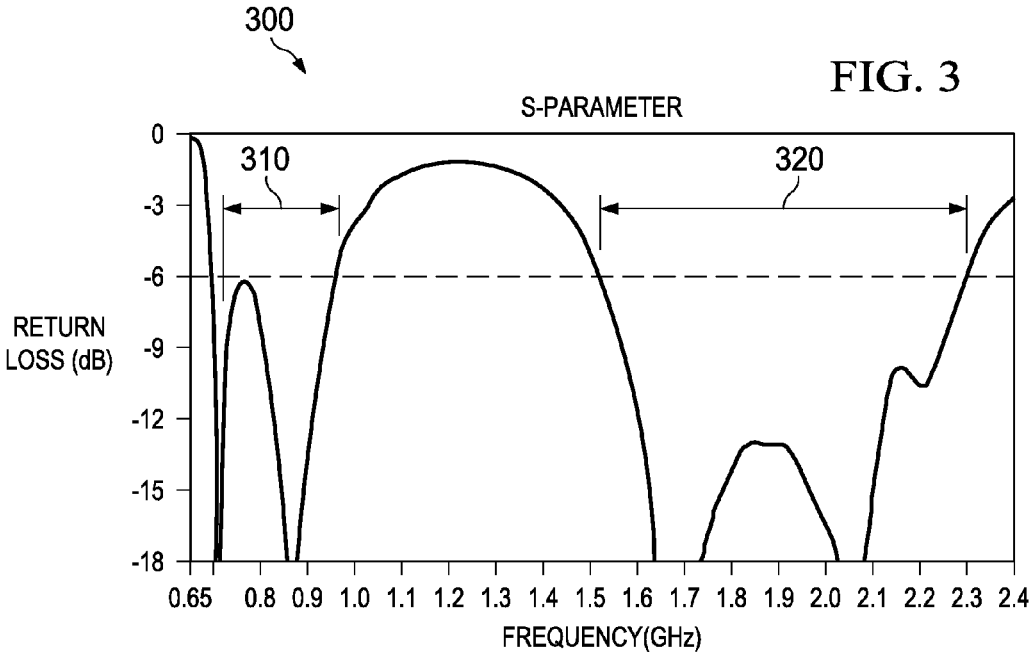
FIG. 3 illustrates an S-parameter plot for a wideband antenna in accordance with the present disclosure.
Figure 4:
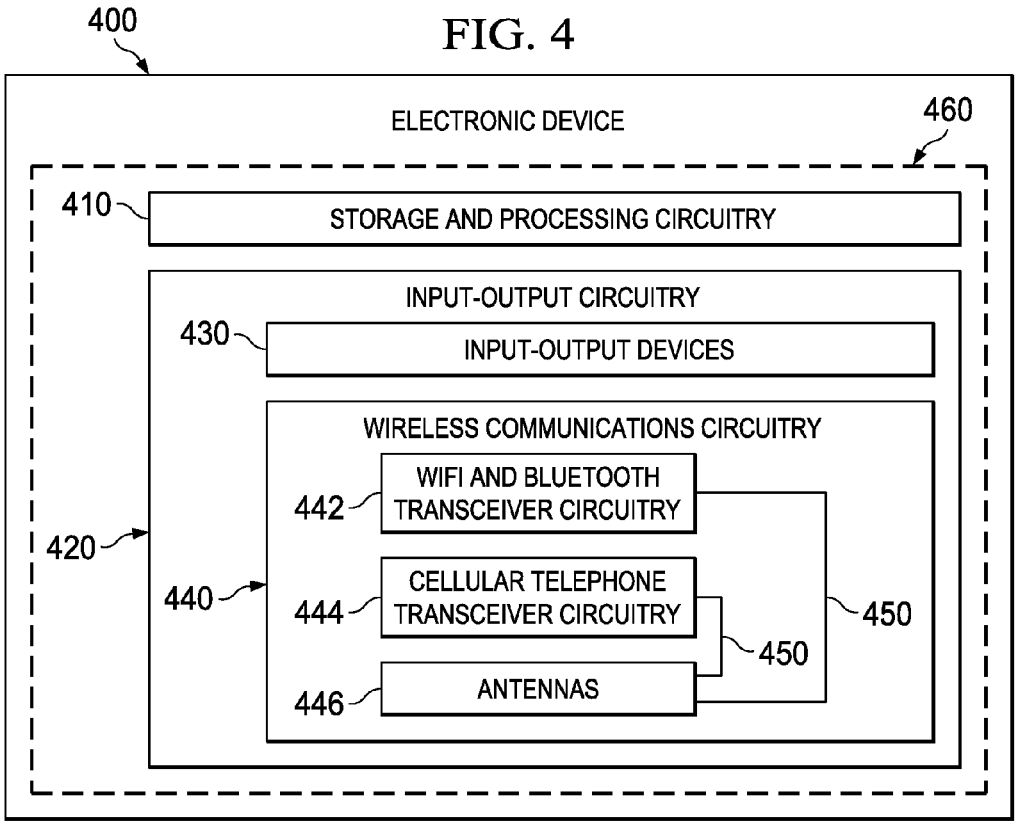
FIG. 4 illustrates a schematic diagram of electronic device in accordance with the disclosure.

FIG. 3 illustrates an S-parameter plot 300 for a wideband antenna in accordance with the present disclosure. The S-parameter plot 300 might, in one embodiment, be representative of the wideband antenna 100 of FIG. 1 or the wideband antenna 200 of FIG. 2. Specifically, plot 300 illustrates the frequencies attainable in the lower band bandwidth 310, as well as the frequencies attainable in the higher band bandwidth 320. Additionally, for these given ranges, the return loss values for the desirable frequencies are well below −6, which is outstanding for a wideband antenna FIG. 4 shows a schematic diagram of electronic device 400 manufactured in accordance with the disclosure. Electronic device 400 may be a portable device such as a mobile telephone, a mobile telephone with media player capabilities, a handheld computer, a remote control, a game player, a global positioning system (GPS) device, a laptop computer, a tablet computer, an ultraportable computer, a combination of such devices, or any other suitable portable electronic device.

As shown in FIG. 4, electronic device 400 may include storage and processing circuitry 410. Storage and processing circuitry 410 may include one or more different types of storage such as hard disk drive storage, nonvolatile memory (e.g., flash memory or other electrically-programmable-read-only memory), volatile memory (e.g., static or dynamic random-access-memory), etc. Processing circuitry in the storage and processing circuitry 410 may be used to control the operation of device 400. The processing circuitry may be based on a processor such as a microprocessor and other suitable integrated circuits. With one suitable arrangement, storage and processing circuitry 410 may be used to run software on device 400, such as internet browsing applications, voice-over-internet-protocol (VOIP) telephone call applications, email applications, media playback applications, operating system functions, etc. Storage and processing circuitry 410 may be used in implementing suitable communications protocols.

Communications protocols that may be implemented using storage and processing circuitry 410 include, without limitation, internet protocols, wireless local area network protocols (e.g., IEEE 802.11 protocols—sometimes referred to as WiFi®), protocols for other short-range wireless communications links such as the Bluetooth® protocol, protocols for handling 3G communications services (e.g., using wide band code division multiple access techniques), 2G cellular telephone communications protocols, etc. Storage and processing circuitry 410 may implement protocols to communicate using 2G cellular telephone bands at 850 MHz, 900 MHz, 1800 MHz, and 1900 MHz (e.g., the main Global System for Mobile Communications or GSM cellular telephone bands) and may implement protocols for handling 3G and 4G communications services.

Input-output device circuitry 420 may be used to allow data to be supplied to device 400 and to allow data to be provided from device 400 to external devices. Input-output devices 430 such as touch screens and other user input interfaces are examples of input-output circuitry 420. Input-output devices 430 may also include user input-output devices such as buttons, joysticks, click wheels, scrolling wheels, touch pads, key pads, keyboards, microphones, cameras, etc. A user can control the operation of device 400 by supplying commands through such user input devices. Display and audio devices may be included in devices 430 such as liquid-crystal display (LCD) screens, light-emitting diodes (LEDs), organic light-emitting diodes (OLEDs), and other components that present visual information and status data. Display and audio components in input-output devices 430 may also include audio equipment such as speakers and other devices for creating sound. If desired, input-output devices 430 may contain audio-video interface equipment such as jacks and other connectors for external headphones and monitors.

Wireless communications circuitry 440 may include radio-frequency (RF) transceiver circuitry formed from one or more integrated circuits, power amplifier circuitry, low-noise input amplifiers, passive RF components, one or more antennas, and other circuitry for handling RF wireless signals. Wireless signals can also be sent using light (e.g., using infrared communications). Wireless communications circuitry 440 may include radio-frequency transceiver circuits for handling multiple radio-frequency communications bands. For example, circuitry 440 may include transceiver circuitry 442 that handles 2.4 GHz and 5 GHz bands for WiFi® (IEEE 802.11) communications and the 2.4 GHz Bluetooth® communications band. Circuitry 440 may also include cellular telephone transceiver circuitry 444 for handling wireless communications in cellular telephone bands such as the GSM bands at 850 MHz, 900 MHz, 1800 MHz, and 1900 MHz, as well as the UMTS, HSPA+ and LTE bands (as examples). Wireless communications circuitry 440 can include circuitry for other short-range and long-range wireless links if desired. For example, wireless communications circuitry 440 may include global positioning system (GPS) receiver equipment, wireless circuitry for receiving radio and television signals, paging circuits, etc. In WiFi® and Bluetooth® links and other short-range wireless links, wireless signals are typically used to convey data over tens or hundreds of feet. In cellular telephone links and other long-range links, wireless signals are typically used to convey data over thousands of feet or miles.

Wireless communications circuitry 440 may include antennas 446. Device 400 may be provided with any suitable number of antennas. There may be, for example, one antenna, two antennas, three antennas, or more than three antennas, in device 400. For example, in one embodiment, the antennas 446 form at least a portion of an antenna, such as the antennas discussed above with regard to FIGS. 1-2, among others. In accordance with the disclosure, the antennas may handle communications over multiple communications bands. Different types of antennas may be used for different bands and combinations of bands. For example, it may be desirable to form a multi-band antenna for forming a local wireless link antenna, a multi-band antenna for handling cellular telephone communications bands, and a single band antenna for forming a global positioning system antenna (as examples).

Paths 450, such as transmission line paths, may be used to convey radio-frequency signals between transceivers 442 and 444, and antennas 446. Radio-frequency transceivers such as radio-frequency transceivers 442 and 444 may be implemented using one or more integrated circuits and associated components (e.g., power amplifiers, switching circuits, matching network components such as discrete inductors and capacitors, and integrated circuit filter networks, etc.). These devices may be mounted on any suitable mounting structures. With one suitable arrangement, transceiver integrated circuits may be mounted on a printed circuit board. Paths 450 may be used to interconnect the transceiver integrated circuits and other components on the printed circuit board with antenna structures in device 400. Paths 450 may include any suitable conductive pathways over which radio-frequency signals may be conveyed including transmission line path structures such as coaxial cables, microstrip transmission lines, etc.

The device 400 of FIG. 4 further includes a chassis 460. The chassis 460 may be used for mounting/supporting electronic components such as a battery, printed circuit boards containing integrated circuits and other electrical devices, etc. For example, in one embodiment, the chassis 460 positions and supports the storage and processing circuitry 410, and the input-output circuitry 420, including the input-output devices 430 and the wireless communications circuitry 440 (e.g., including the WIFI and Bluetooth transceiver circuitry 442, the cellular telephone circuitry 444, and the antennas 446.

The chassis 460, in one embodiment, is a metal chassis. For example, the chassis 460 may be made of various different metals, such as aluminum. Chassis 460 may be machined or cast out of a single piece of material, such as aluminum. Other methods, however, may additionally be used to form the chassis 460. In certain embodiments, the chassis 460 will couple to at least a portion of the antennas 446.

Those skilled in the art to which this application relates will appreciate that other and further additions, deletions, substitutions and modifications may be made to the described embodiments.

What is claimed is:

1. An antenna, comprising:

a feed element having a first feed element end and a second feed element end, the first feed element end configured to electrically connect to a positive terminal of a transmission line, the feed element further including a first feed element section and a second feed element section, the first and second feed element sections being substantially perpendicular to one another; and a ground element having a first ground element end and a second ground element end, as well as a first ground element section, a second ground element section connected to the first ground element section, a third ground element section connected to the second ground element section, and a fourth ground element second connected to the third ground element section, wherein the first ground element end configured to electrically connect to a negative terminal of the transmission line, wherein the first ground element end is located proximate and inside the first feed element end, and the second ground element end is located proximate and outside the second feed element end.

2. The antenna of claim 1 wherein the ground element is substantially parallel to the feed element.

3. The antenna of claim 1, wherein the first and second ground element sections are substantially perpendicular to one another, the second and third ground element sections are substantially perpendicular to one another, and the third and fourth ground element sections are substantially perpendicular to one another.

4. The antenna of claim 3, wherein the first and third ground element sections are substantially parallel to one another, and the second ground element section is substantially perpendicular to at least a portion of the fourth ground element section.

5. The antenna of claim 1, wherein the fourth ground element section surrounds the second feed element section by a distance ($D_1$).

6. The antenna of claim 5, wherein the fourth ground element section has a length ($L_{G4}$) and the second feed element section has a length ($L_{F2}$), and further wherein the distance ($D_1$) is at least about ⅙ the length ($L_{G4}$).

7. The antenna of claim 6, wherein the distance ($D_1$) is at least about ¼ the length ($L_{G4}$).

8. The antenna of claim 1, wherein the second feed element end is fully surrounded by the ground element.

9. The antenna of claim 1, further including a parasitic element configured to electrically connect to the negative terminal of the transmission line.

10. The antenna of claim 9, wherein the parasitic element has a first parasitic element section and a second parasitic element section, and further wherein the first parasitic element section is substantially perpendicular to the second parasitic element section.

11. The antenna of claim 1, wherein a maximum spacing ($S_1$) between the feed element and the ground element is less than about three times a minimum thickness ($T_1$) of the feed element.

12. The antenna of claim 9, wherein a maximum spacing ($S_1$) between the feed element and the ground element is less than about 3 mm.

13. The antenna of claim 1, wherein the feed element and ground element cooperate to form a magnetically coupled slot antenna.

14. An electronic device, comprising:

storage and processing circuitry;

input-output devices associated with the storage and processing circuitry; and wireless communications circuitry including an antenna, the antenna including;

a feed element having a first feed element end and a second feed element end, the first feed element end electrically connected to a positive terminal of a transmission line;

a ground element having a first ground element end and a second ground element end, the first ground element end electrically connected to a negative terminal of the transmission line, wherein the first ground element end is located proximate and inside the first feed element end, and the second ground element end is located proximate and outside the second feed element end; and a parasitic element electrically connected to the negative terminal of the transmission line.

15. The electronic device of claim 14, wherein the second feed element end is fully surrounded by the ground element.

16. The electronic device of claim 14, wherein a maximum spacing ($S_1$) between the feed element and the ground element is less than about 3 mm.

17. The electronic device of claim 14, wherein the storage and processing circuitry, input-output devices, and wireless communications circuitry are positioned within a conductive chassis, and further wherein the ground element is connected to the conductive chassis.

18. An antenna, comprising:

a feed element having a first feed element end and a second feed element end, the first feed element end configured to electrically connect to a positive terminal of a transmission line; and a ground element having a first ground element end and a second ground element end, the first ground element end configured to electrically connect to a negative terminal of the transmission line, wherein the first ground element end is located proximate and inside the first feed element end, and the second ground element end is located proximate and outside the second feed element end, and further wherein the feed element and ground element cooperate to form a magnetically coupled slot antenna.

19. The antenna of claim 18, wherein a maximum spacing ($S_1$) between the feed element and the ground element is less than about three times a minimum thickness ($T_1$) of the feed element.

20. The antenna of claim 19, wherein a maximum spacing ($S_1$) between the feed element and the ground element is less than about 3 mm.

* * * * *